US006658668B2

(12) United States Patent
Newcomb

(10) Patent No.: US 6,658,668 B2
(45) Date of Patent: Dec. 9, 2003

(54) OVEN GLOVE WITH GRIPPING ELEMENT

(76) Inventor: Don Newcomb, 2211 Jeff Davis Dr., Oxford, MS (US) 38655

( * ) Notice: Subject to any disclaimer, the term of this patent is extended or adjusted under 35 U.S.C. 154(b) by 22 days.

(21) Appl. No.: 10/058,296

(22) Filed: Jan. 30, 2002

(65) Prior Publication Data

US 2003/0140395 A1 Jul. 31, 2003

(51) Int. Cl.[7] ..... A41D 19/00

(52) U.S. Cl. ..... 2/160; 2/161.6; 2/158; 294/25

(58) Field of Search ..... 2/158, 16, 20, 2/21, 160, 161.6, 163; 56/400.01; D29/119; 294/49, 9, 12, 25

(56) References Cited

U.S. PATENT DOCUMENTS 3,593,803 A * 7/1971 Ibach ..... 172/10
4,149,601 A * 4/1979 Taylor ..... 172/370
5,878,438 A * 3/1999 Ragsdale ..... 2/158
5,878,439 A * 3/1999 Waters, Jr. ..... 2/161.6
6,279,165 B1 * 8/2001 Kobayashi ..... 2/163
6,374,417 B1 * 4/2002 Stagnitta ..... 2/161.8

* cited by examiner

*Primary Examiner*—Katherine Moran
(74) *Attorney, Agent, or Firm*—Larson & Taylor, PLC

(57) ABSTRACT

An oven glove is provided with a gripping element affixed to a thumb piece of the glove so as to enable a wearer or user to handle or grasp hot dishes, pots, pans or like items. The gripping element extends outwardly from the thumb piece so as to permit the gripping element to be positioned a sufficient amount over an edge of a hot item so as to enable the user to move the item. Heat retardant pads are also provided on the glove.

17 Claims, 1 Drawing Sheet

OVEN GLOVE WITH GRIPPING ELEMENT

FIELD OF THE INVENTION

The present invention relates to heat protective devices such as pot holders and oven mitts which enable a wearer or user to handle hot items from an oven or microwave.

BACKGROUND OF THE INVENTION

A heat protective hand covering device such as an oven mitt or pot holder is often used during cooking to handle hot items in the kitchen. However, because oven mitts and pot holders are relatively large, thick and bulky, it is often difficult to securely grasp and move a pan or dish from an oven or microwave. In addition, the oven mitt or pot holder frequently becomes soiled because part of the mitt or pot holder invariably gets into the food that the dish contains. Further, oven mitts and pot holders often. provide limited heat protection and there is a risk of burning the hand when handling the hot item for an extended period of time.

U.S. Pat. No. 2,889,556 to Mehler discloses a soil resistant and heat reflective oven mitt including a panel comprising an absorbent layer and an exterior heat reflecting and stain resisting layer on each side of the absorbent layer. The panel defines a hand receiving portion including a thumb cot attached thereto. One shortcoming of the oven mitt of the Mehler patent is that the mitt is large, thick and bulky, making it difficult for a wearer to grasp a dish. Further, the wearer must wash off any soiled material collected on the surface of the mitt.

SUMMARY OF THE INVENTION

A principal object of the present invention is to provide a hand covering device comprising a gripping element attached to a thumb piece so as to enable a wearer to securely grip hot items and reduce soilage on the thumb piece.

A more specific object of the invention is to provide a heat protective device comprising a gripping element that is attached to a thumb piece and extends outwardly from the thumb piece so as to permit the wearer to position the gripping element over an edge of a hot item to enable the item to be moved.

Another object of the invention is to provide a glove device that may be conveniently and comfortably worn upon the hands while protecting the hands from injury due to burns.

In accordance with one aspect of the invention, there is provided a hand covering device for handling hot items in a kitchen, said hand covering device comprising: a hand covering member having a front side including heat retardant material; a thumb piece affixed to said hand covering member, said thumb piece including heat retardant material; and a gripping element affixed to said thumb piece for enabling gripping of an item, said gripping element extending outwardly from said thumb piece away from said heat retardant material of the thumb piece.

In accordance with a further aspect of the invention, a glove device is provided for enabling a wearer to remove hot items from an oven or microwave, the glove device comprising: a hand receiving member including an opening for receiving a hand of the wearer, said member having a palm side, and said palm side including heat retardant material; said hand receiving member further including a thumb receiving portion including heat retardant material; and a gripping projection secured to said thumb receiving portion for enabling the wearer to grip hot items, said projection extending outwardly from said thumb receiving portion so as to permit said projection to be positioned over an edge of a hot item to enable the item to be moved. As used herein, the word "glove device" is intended to cover both mitts and gloves with separate fingers.

In accordance with another aspect of the invention, there is provided an oven glove device for handling hot items, said glove device comprising: a main panel including a hand receiving portion having a palm side, said palm side including at least one heat retardant pad; a thumb piece affixed to said main panel said thumb piece including at least one heat retardant pad; and a gripping element attached to said thumb piece, said gripping element projecting outwardly from said thumb piece.

Further features and advantages of the present invention will be set forth in, or apparent from, the detailed description of preferred embodiments thereof which follows.

DESCRIPTION OF THE PREFERRED EMBODIMENTS

Figure 1:
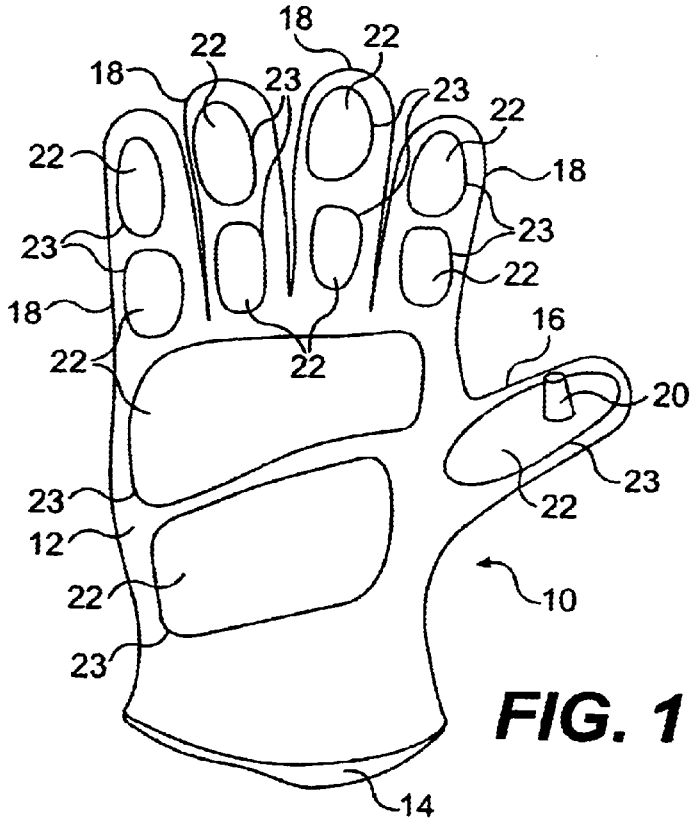
FIG. 1 is a front elevational view showing the front or palm side of an oven glove in accordance with one preferred embodiment of the present invention.

Referring to FIG. 1, a hand covering device or glove device is shown, which is generally denoted 10. Although a right-handed glove device is shown, it will be understood that the hand covering device can also be a left-handed covering device and that either one hand covering device or a pair of such hand covering devices can be provided to handle hot items. The hand covering device 10 includes a hand receiving member or a hand covering member 12 that forms a main panel of device 10. The hand receiving member 12 includes an opening 14 for receiving the hand of a user. A thumb piece or thumb receiving member 16 is formed integrally with, or affixed to, the hand receiving member 12. The glove device 10 also includes four finger extensions or finger receiving members 18 which are formed integrally with, or attached to, the hand receiving member 12. As described thus far, glove device 10 is of conventional construction and it will be appreciated that gloves of other shapes and configurations can be employed.

Glove device 10 also includes a gripping element 20 which is attached to the thumb piece 16 and extends outwardly from the thumb piece 16. The gripping element 20 preferably extends perpendicularly with respect to the thumb piece 16 as illustrated but can extend at a different angle so long as element 20 is able to perform its gripping function.

The front or palm side of the main panel of member 12, as well as the thumb piece 16, and each of the finger extensions 18 include heat retardant areas 22 which allows a wearer to handle hot items for prolonged periods of time without sustaining burns. The heat retardant areas 22 preferably comprise heat retardant pads 23 of different sizes adapted to be accommodated on the corresponding portion of glove device 10.

In a specific, non-limiting example, the heat retardant pads 23 are positioned on the finger extensions 18 and are approximately ⅛ inch thick, 2 inches long and ½ inch wide. The retardant pads 23 are adapted to prevent heat from reaching the fingers. Similarly, the front or palm side of member 12 can be totally covered with a single heat retardant pad 23 or can be covered by a plurality of heat retardant pads 23 as illustrated. Although such pads are advantageous, it will be appreciated that the heat retardant areas 22 can be comprised of heat retardant material formed integrally with or affixed to the finger extensions 18, thumb piece 16 and the front or palm side of the hand receiving member 12.

Gripping element 20 is preferably a fire retardant element constructed of a heat resistant or heat retardant plastic material or of wood. The gripping element 20 can be physically constructed in various geometrical shapes including square or rectangular and can also be of a round cylindrical shape. In general, the size and shape of the gripping element 20 is selected so as to permit the gripping element 20 to be positioned a sufficient amount over an edge of a hot dish, pot, pan or like item to enable the dish or item to be moved using the element 20. It will be appreciated that because the gripping element 20 is positioned over the edge of a dish or pot a sufficient amount, the tip of the thumb piece 16 does not make contact with the contents of the dish, thus reducing soilage of the glove device 10.

Figure 2:
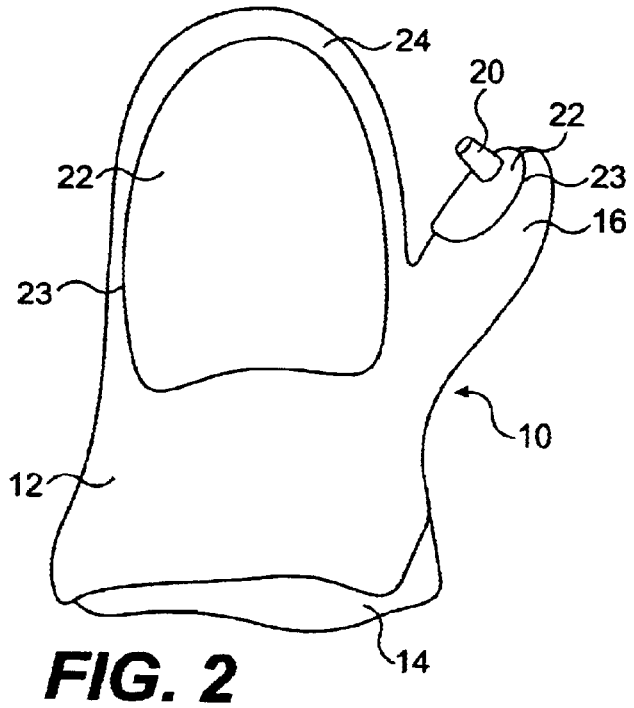
FIG. 2 is a front elevational view of the front or palm side of an oven mitt in accordance with a second preferred embodiment of the present invention.

Referring to FIG. 2, a second preferred embodiment of the invention is shown. This embodiment is similar to that of FIG. 1 and like elements have been given the same reference numerals. The embodiment of FIG. 2 mainly differs from that of FIG. 1 in that device 10 of FIG. 2 is an oven mitt with a single mitt portion 24 for receiving the fingers of the hand of a wearer. A heat retardant area 22 covers both mitt portion 24 and a portion of thumb piece 16 surrounding gripping element 20. Other configurations can also be used.

In a further, non-illustrated embodiment, hand covering device in the form of a pot holder (not shown) is provided with a thumb piece with a gripping element corresponding to that described above.

Although the invention has been described above in relation to preferred embodiments thereof, it will be understood by those skilled in the art that variations and modifications can be effected in these preferred embodiments without departing from the scope and spirit of the invention.

What is claimed:

1. A hand covering device for enabling a user to remove hot items from an oven, said hand covering device comprising:

a hand covering member having a front side including heat retardant material; and a thumb piece affixed to said hand covering member, said thumb piece including heat retardant material;

said device further comprising a single gripping element, comprised of a heat retardant material, affixed only to an end portion of said thumb piece for enabling gripping and removal of an item in an oven, said gripping element extending outwardly from said thumb piece away from said heat retardant material of the thumb piece.

2. A hand covering device according to claim 1, wherein said device is an oven mitt.

3. A hand covering device according to claim 1, wherein said device further comprises finger extensions affixed to said hand covering member.

4. A hand covering device according to claim 3, wherein each of said finger extensions includes heat retardant material.

5. A hand covering device according to claim 4, wherein said heat retardant material of said finger extensions comprises at least one heat retardant pad.

6. A hand covering device according to claim 1, wherein said gripping element comprised of a heat retardant plastic material.

7. A hand covering device according to claim 1, wherein said gripping element comprises a wooden element.

8. A hand covering device according to claim 1, wherein said heat retardant material of said hand covering member and said thumb piece comprises at least one heat retardant pad.

9. A glove device for enabling a wearer to remove hot items from an oven or microwave, said device comprising:

an oven mitt comprising:

a hand receiving member including an opening for receiving a hand of the wearer, said member having a palm side, said palm side including heat retardant material; and said hand receiving member further including a thumb receiving portion including heat retardant material;

said device further comprising a single gripping projection, comprised of heat retardant material and secured only to an inner surface of an end part of said thumb receiving portion, for enabling the wearer to grip hot items, said projection extending outwardly from said thumb receiving portion so as to permit said projection to be positioned over an edge of a hot item to enable the item to be moved and said oven mitt being otherwise free of gripping projections.

10. A glove device according to claim 9, wherein said heat retardant material comprises of at least one heat retardant pad.

11. A glove device according to claim 9, wherein said gripping projection comprises a heat retardant element.

12. A glove device according to claim 9, wherein said gripping projection comprises a heat retardant plastic element.

13. A glove device according to claim 9, wherein said gripping projection comprises a wooden element.

14. A glove device according to claim 9, wherein said heat retardant material comprises at least one heat retardant pad.

15. An oven glove device for enabling hot items to be removed from an oven, said glove device comprising:

a main panel including a hand receiving portion having a palm side, said palm side including at least one heat retardant pad;

a plurality of finger extensions affixed to said main panel, each of said finger extensions including heat retardant material, and the heat retardant material comprising at least one heat retardant pad; and a thumb piece affixed to said main panel, said thumb piece including a heat retardant pad; and said device further comprising a single gripping element, comprised of a heat retardant material, attached only to said thumb piece, said gripping element projecting outwardly from the heat retardant pad of said thumb piece, and said main panel and said finger extensions being free of gripping elements.

16. An oven glove device according to claim 15, wherein said gripping element comprises a heat retardant plastic element.

17. An oven glove device according to claim 15, wherein said gripping element comprises a wooden element.

* * * * *